United States Patent [19]

van der Lely et al.

[11] 4,073,099

[45] Feb. 14, 1977

[54] ROOFING OF BUILDINGS

[76] Inventors: Cornelis van der Lely, 7 Brueschenrain, Zug; Hendricus Jacobus Cornelis Nieuwenhoven, Hirssattelweg, Baar, both of Switzerland

[21] Appl. No.: 657,053

[22] Filed: Feb. 11, 1976

Related U.S. Application Data

[63] Continuation of Ser. No. 545,739, Jan. 30, 1975, abandoned, which is a continuation of Ser. No. 339,366, March 8, 1973, abandoned.

[30] Foreign Application Priority Data

Mar. 10, 1972 Netherlands ..... 7203175

[51] Int. Cl.[2] ..... E04B 7/16

[52] U.S. Cl. ..... 52/69; 52/90; 52/641; 52/79.1

[58] Field of Search ..... 52/69, 79, 90, 64, 641; 248/188.6, 439, 165, 166, 207, 514

[56] References Cited

U.S. PATENT DOCUMENTS

| | | | |
|---|---|---|---|
| 2,199,897 | 5/1940 | Stringer | 248/514 X |
| 3,214,872 | 11/1965 | Vogelgesang | 52/90 X |
| 3,404,496 | 10/1968 | Ballard | 52/641 X |
| 3,605,355 | 9/1971 | Solesbee | 52/90 |
| 3,653,165 | 4/1972 | West | 52/90 |
| 3,727,354 | 4/1973 | Powell | 52/90 |

FOREIGN PATENT DOCUMENTS

| | | | |
|---|---|---|---|
| 644,256 | 10/1950 | United Kingdom | 52/90 |
| 619,590 | 10/1949 | United Kingdom | 52/90 |

*Primary Examiner*—Karl Bell
*Attorney, Agent, or Firm*—Mason, Mason & Albright

[57] ABSTRACT

A building constructed of five prefabricated space-bounding elongated parallelepiped sections with a roof having four sides shaped substantially like a truncated pyramid with a single chimney projecting through the truncated portion and the angle of incline of the roof sides being reduced in the areas adjacent its perimeter. The sections are each constructed with like frameworks of metal beams and connected in a side-by-side relationship to form a rectangle as seen in plan. All heating and plumbing facilities are in the center section and the necessary vents therefor lead through the aforesaid chimney so that additional openings in the roof are not required. The center section also has roof supports connected to and across the upper portion of its framework of metal beams near where the chimney projects so as to be pivotable from a horizontal position for transport to a vertical position where it is secured to support the roof about the chimney. Intermediate roof supports are provided between the first mentioned roof support and perimeter of the roof which, where parallel to the underlying framework of beams, are supported by said beams unless the beam involved is unsupported over the longer part of a section in which case the intermediate roof support is a truss across the unsupported beam portion. Standard frameworks may be used in manufacturing the sections which are thus not required to have an unnecessary redundancy of strength with the attendant increased weight and costs.

26 Claims, 12 Drawing Figures

ROOFING OF BUILDINGS

RELATED APPLICATIONS

This is a continuing application of application Ser. No. 545,739 filed Jan. 30, 1975 now abandoned, which is a continuing application of application Ser. No. 339,366 filed Mar. 8, 1973 now abandoned.

This invention relates to buildings, and to methods for their erection, such buildings being of the kind comprising at least one prefabricated room unit or space-bounding section and a roof.

According to one aspect of the invention, there is provided a building of the kind set forth, wherein at least part of the roof is disposed at a distance above the top of each room unit or section and is connected to at least one roof support that is mounted on the top of the room unit or section or at least one of the room units or sections.

According to a further aspect of the invention, there is provided a method of mounting the roof on a building of the kind set forth, wherein the method comprises providing the top of said one room unit or section with a roof support arranged in a lowered position, transporting said room unit or section to a building site with said roof support in the lowered position, bringing the roof support to an upright operative position at the building site and mounting the roof so as to be wholly or partly sustained by said support.

Figure 1:
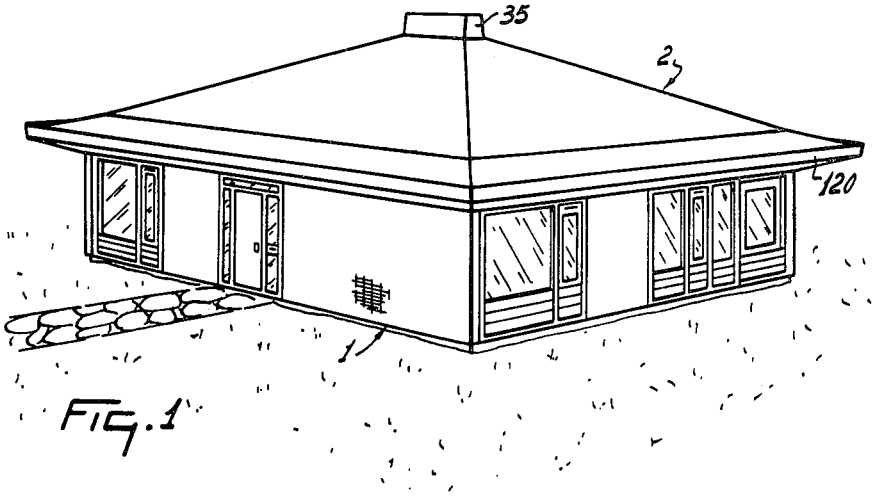
Figure 2:
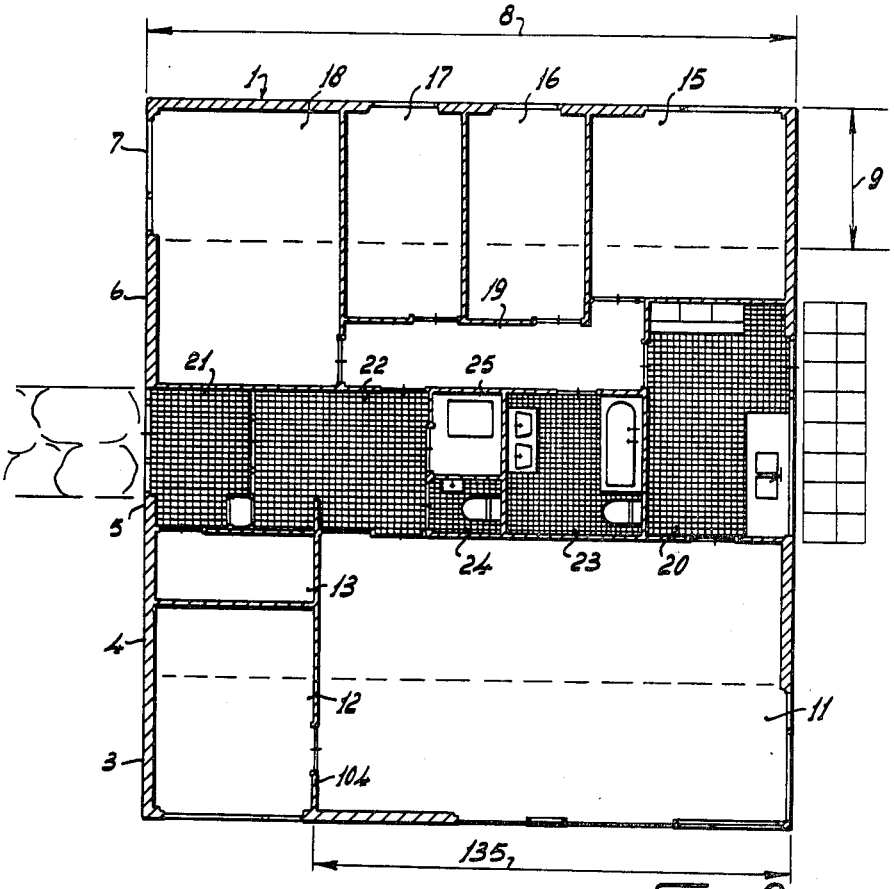

For a better understanding of the invention, and to show how the same may be carried into effect, reference will now be made, by way of example, to the accompanying drawings, in which:

FIG. 1 is a perspective view of a prefabricated bungalow embodying the invention, FIG. 2 is a plan view of the bungalow of FIG. 1 but with the roof removed.

Figure 3:
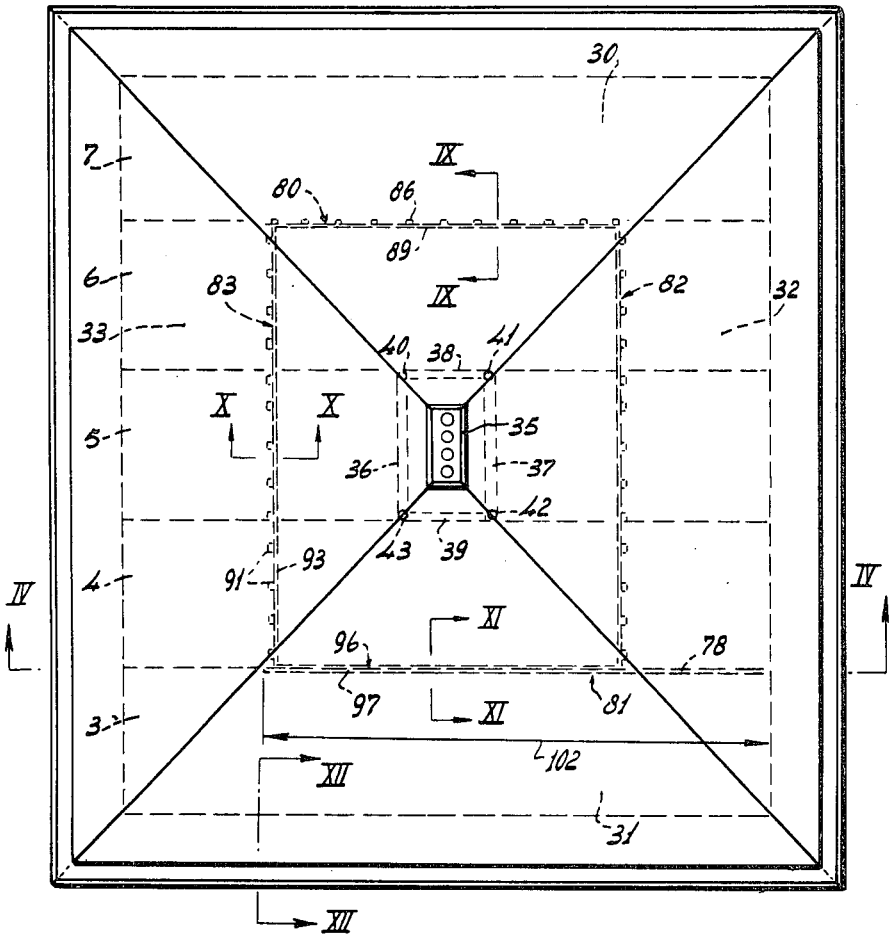
Figure 4:
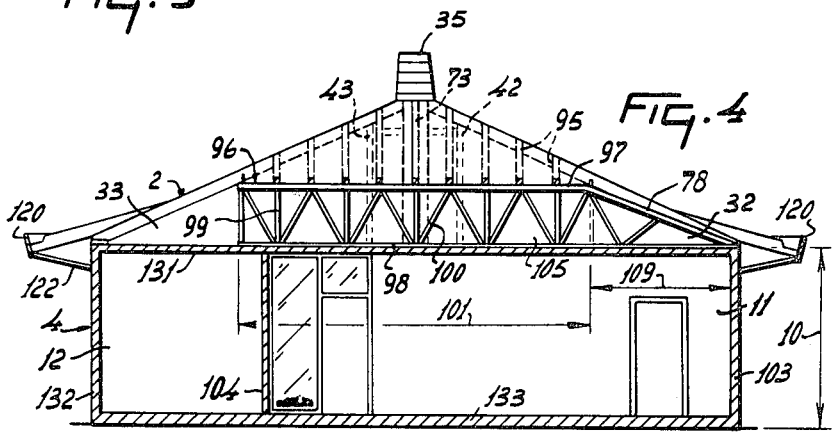
Figure 5:
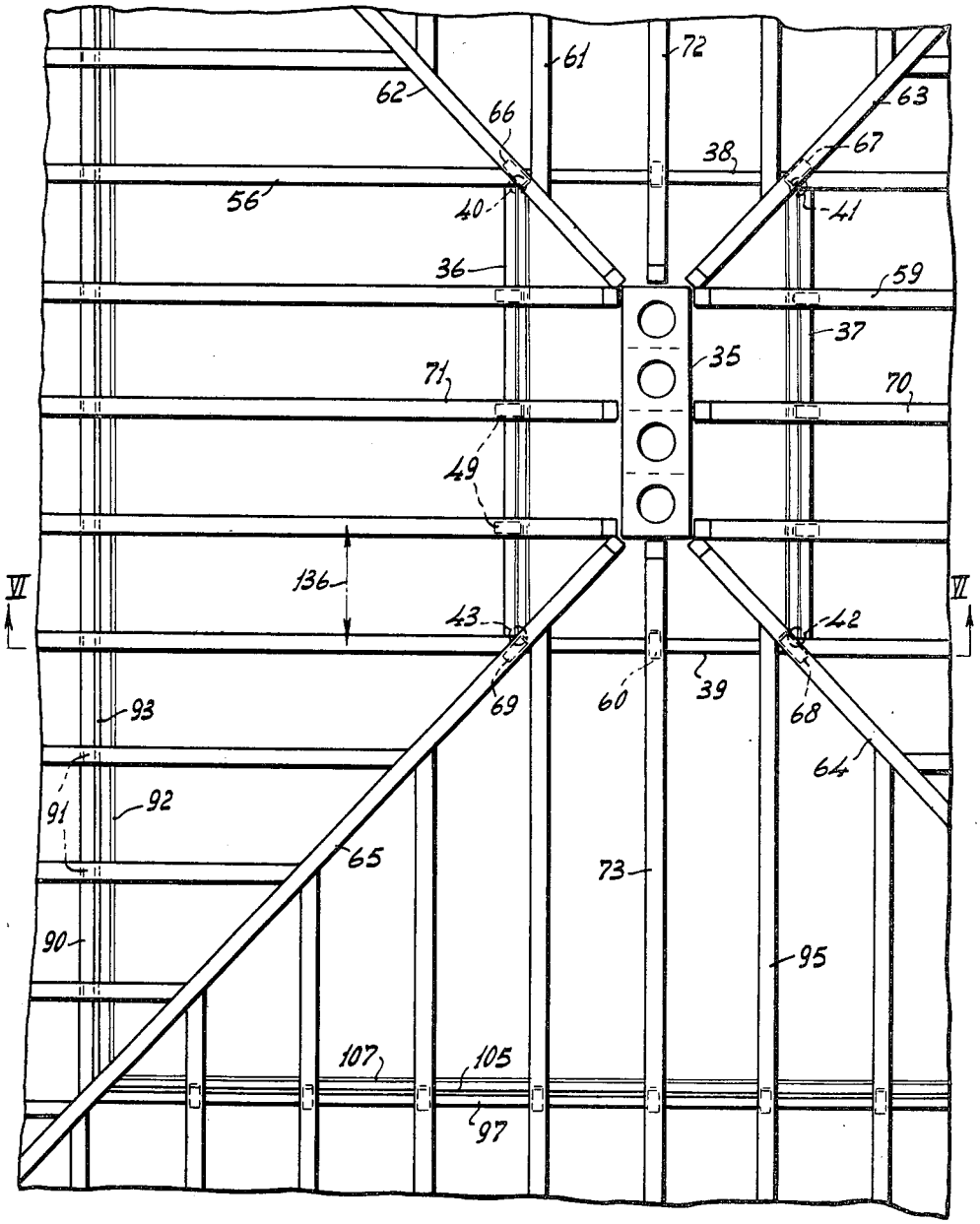
Figure 6:
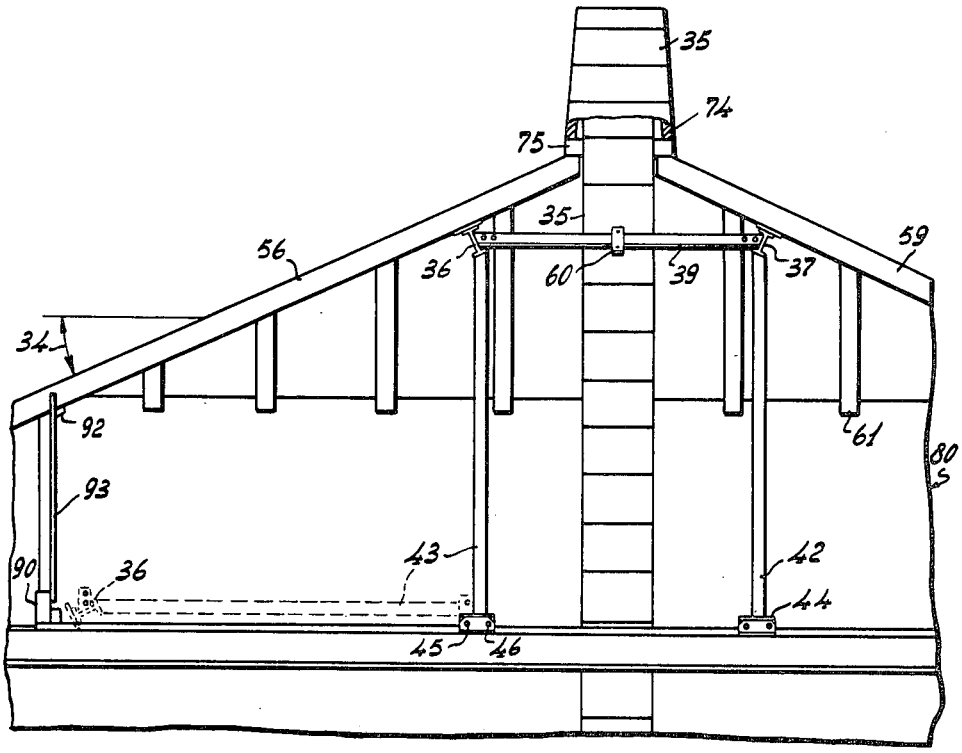
Figure 12:
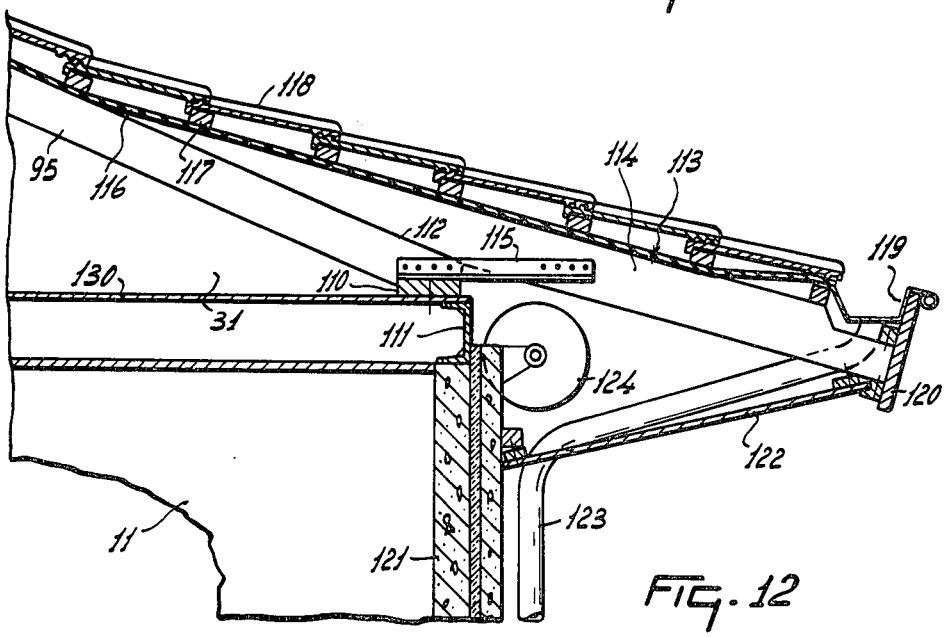
Figure 7:
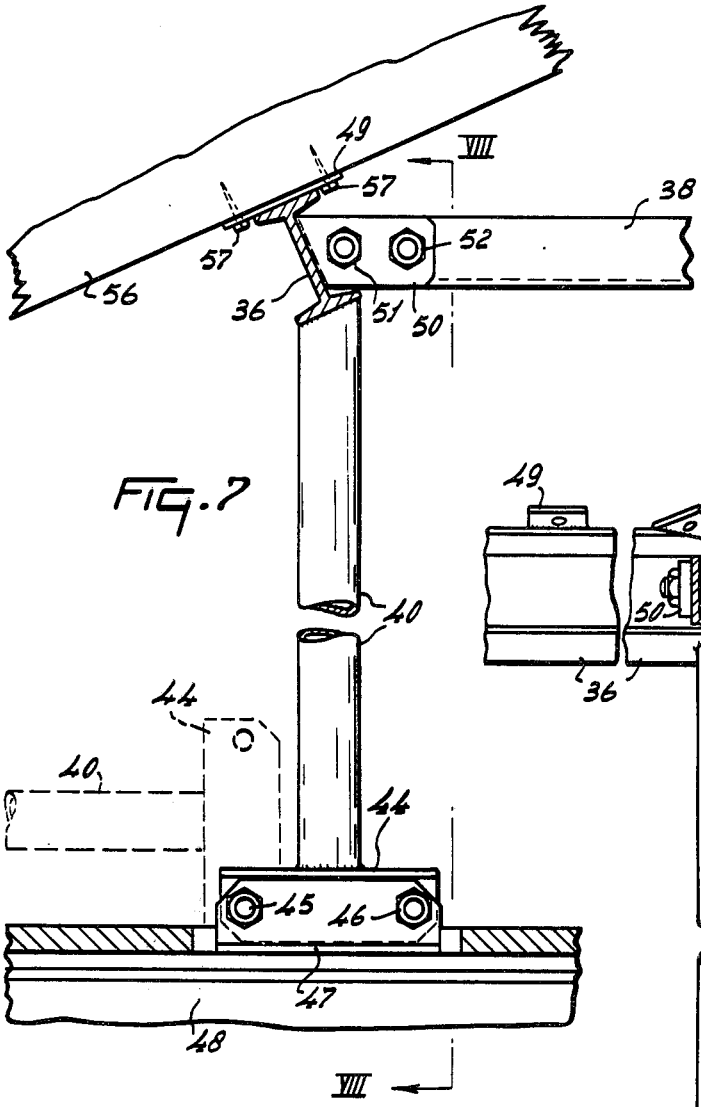
Figure 8:
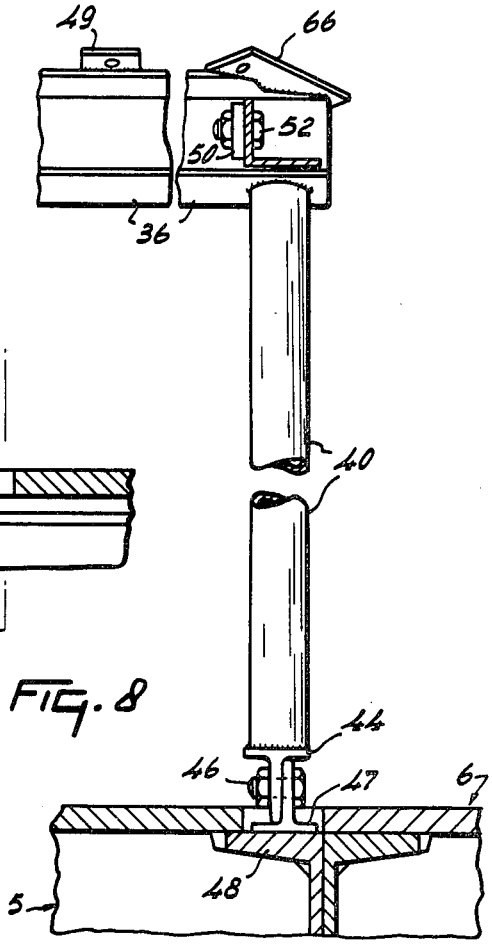
Figure 9:
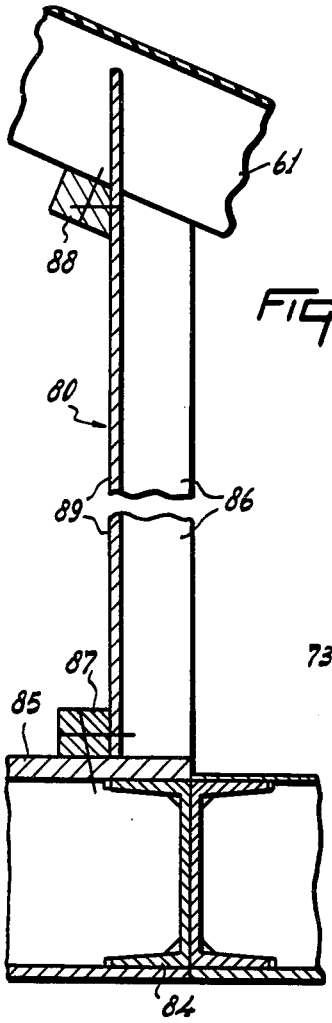
Figure 10:
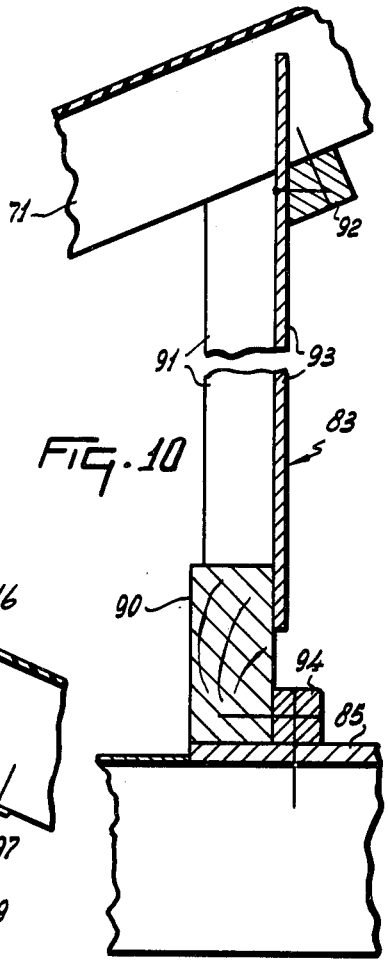
Figure 11:
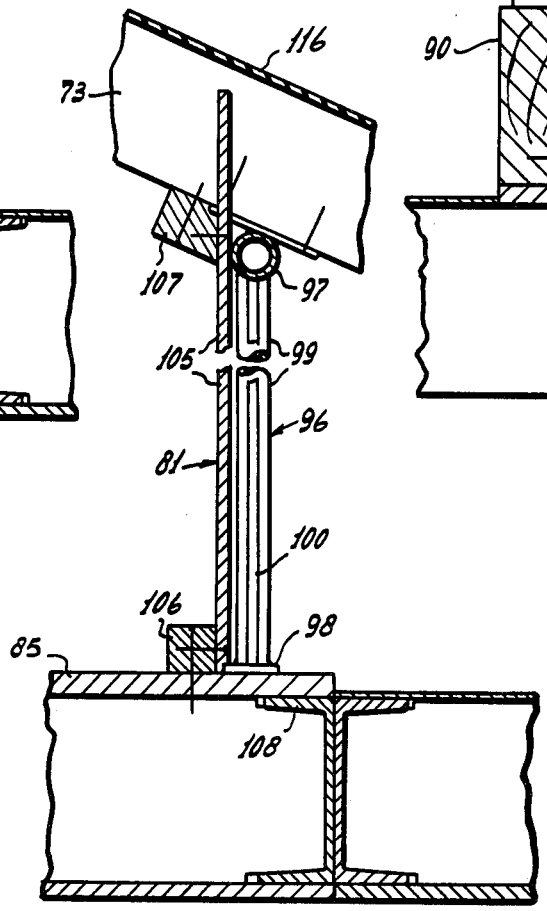

FIG. 3 is a plan view corresponding to FIG. 2 but with the roof in position, FIG. 4 is a section taken on the line IV—IV of FIG. 3, FIG. 5 is a plan view, to an enlarged scale, showing the supporting structure or skeleton of the roof in greater detail, FIG. 6 is a section taken on the line VI—VI of FIG. 5, FIG. 7 is a elevation showing certain parts that are visible in FIG. 6 to an enlarged scale and in greater detail, FIG. 8 is a section taken on the line VIII—VIII of FIG. 7, FIG. 9 is a section, to an enlarged scale, taken on the line IX—IX of FIG. 3, FIG. 10 is a section, to an enlarged scale, taken on the line X—X of FIG. 3, FIG. 11 is a section, to an enlarged scale, taken on the line XI—XI of FIG. 3, and FIG. 12 is a section, to an enlarged scale, taken on the line XII—XII of FIG. 3.

Referring to the drawings, the prefabricated building which is illustrated is a bungalow having substantially only a single 1 on top of which a roof 2 is mounted. The 1 is formed from five juxtaposed prefabricated room units or spacebounding sections 3, 4, 5, 6 and 7 each of which has a generally parallelepiped shape. Each room unit or section has an overall length 8 (FIG. 2) of substantially twelve, a width 9 of substantially two and a height 10 (FIG. 4) of substantially three. Each of the units or sections 3 to 7 is a self-supporting prefabricated structure, the five units or sections being formed in such a way that, when correctly juxtaposed, they co-operate with one another to provide the required enclosed rooms and other three-dimensional spaces of 1.

In the illustrated in the accompanying drawings, each of the units or sections 3 to 7 has a three-dimensional frame formed from beams that are arranged principally in its boundary walls. The skeletal frame of each unit or section has secured to it a floor 133 (FIG. 4), a ceiling 131 and principal end or head walls 103 and 132. As previously explained, the different units or sections 3 to 7 enclose various parts of the rooms and other spaces of 1, the sections 3 and 4 comprising a living room 11, a study or other room 12 and a storage room 13. The sections 6 and 7 comprise four bedrooms 15, 16, 17 and 18, a corridor 19 and part of a kitchen 20. The middle unit or section 5 defines the rest of the kitchen 20, a vestibule 21, a hall 22, a bathroom 23, a toilet 24 and a boiler or funance room 25.

The roof 2 comprises four portions 30, 31, 32 and 33 each of which is inclined to both the horizontal and the vertical. The roof 2 bears on the top of the single 1 and the surfaces of its inclined portions 30 to 33 inclusive each make an angle 34 (FIG. 6) to the horizontal of substantially 30°. The upper ends of the four inclined roof portions 30 to 33 inclusive adjoin a central chimney 35 of the bungalow and are kept in their appointed positions relative to that chimney by a rectangular framework comprising two parallel beams 36 and 37 of I-shaped cross-section opposite ends are fastened to two further parallel beams 38 and 39 of L-shaped cross-section, the beams 38 and 39 being perpendicular to the beams 36 and 37. The framework of beams 36 to 39 is mounted at the top of four vertical supporting beams 40, 41, 42 and 43. The two vertical supporting beams 40 and 43 and the horizontal beam 36 that is secured to the upper ends thereof together afford an arched roof support for the roof 2, said arched roof support being arranged on top of the central room unit or section 5 of 1. The vertical supporting beams 41 and 42 and the horizontal beam 37 that interconnects their upper ends forms a second similar arched roof support that is also secured to the top of the central room unit or section 5.

The vertical supporting beams 40 to 43 are all fastened to the top of the unit or section 5 in a similar maner which is shown in detail only in respect of the beam 40 in FIGS. 7 and 8 of the drawings. The lower end of the beam 40 is welded or otherwise rigidly secured to the top of a bar or beam 44 of T-shaped cross-section, said bar or beam 44 constituting a foot for the beam 40. Two bolts 45 and 46 are entered through horizontally spaced apart holes in the upright of the T-shaped bar or beam 44 and also through aligned holes in the upright of an anchorage or support 47 of inverted T-shaped cross-section, the cross bar of said support 47 being welded or otherwise rigidly secured to an upper flange of a beam 48 of channel-shaped cross-section that forms part of one of the longer sides of the room unit section 5 beam 48 is one of the beams forming the three-dimensional skeleton of section 5. The opposite ends of the beam 36 at the top of the two beam 40 and 43 are provided with lateraly projecting lugs or plates 50 to which the ends of the two beams 38 and 39 of L-shaped cross-section are secured by corresponding pairs of bolts 51 and 52. The beam 36 is secured to the upper ends of the two beams 40 and 43 in such a way that the general plane of its upper flange is parallel to the general plane of the roof portion 33. The top surface of the upper flange of the beam 36 is provided with a number of fastening members in the form of plates 49 that extend beyond the edges of the flange in the manner that can be seen in FIG. 7 of the drawings. The roof portion 33 includes a plurality of parallel supporting beams 56 and the margins of the plates 49 are fastened to the lower surfaces of the beams 56 by boltheaded screws 57.

The roof portion 32 includes a plurality of parallel supporting beams 59 that are arranged similarly to the supporting beams 56 and these beams are connected to fastening members carried by the beam 37 in a substantially symmetrically identical manner to that which has already been described with reference to FIGS. 7 and 8 of the drawings in connection with the beam 36 and the supporting beams 56. The beam 39 of L-shaped cross-section carries a central supporting plate 60 (FIGS. 5 and 6) which is fastened to a supporting beam 73 of the roof portion 31. A central supporting plate carried by the beam 38 of L-shaped cross-section is similarly secured to a supporting beam 72 of the roof portion 30. Beams 62, 63, 64 and 65 of angular cross-section are provided in the regions of the adjoining edges of the four inclined roof portions 30 to 33, said beams 62 to 65 bearing upon corresponding fastening pltes 66, 67, 68 and 69 (FIGS. 5 and 8) that are secured to the opposite ends of the beams 36 and 37. The fastening plates 66 to 69 are so positioned that their upper surfaces are substantially coplanar with the lower surfaces of limbs of the angular cross-section beams 62 to 65 that bear respectively thereagainst. Boltheaded screws similar to the screws 57 are employed to secure the beams 62 to 65 to the fastening plates 66 to 69 respectively. The upper ends of the supporting beams 56, 61 and 95 of the roof portions 30 to 33 that adjoin the angular beams 62 to 65 are secured to the later beams in a manner which is not shown in detail in the drawings.

The supporting beams 59, 72 and 73 and further supporting beams 70 and 71 upper ends do not adjoin the angular beams 62 to 65 are all secured to the plates 49 in the manner that has already been described with reference to FIGS. 7 and 8 of the drawings. These beams 59 and 70 to 73 have their upper ends in adjoining relationship with the chimney 35 (see FIG. 5), it being noted that the opposite roof portions 32 and 33 each have three beams 59, 70 and 71 respectively upper ends adjoin, the chimney 35 while the other opposite roof portions 30 and 31 each have only one beam, 72 and 73 respectively, whose upper end adjoin the chimney 35. All of the four angular beams 62 to 65 at the four corners of the roof 2 have their upper ends in adjoining relationship with the corresponding corners of the chimney 35. The uppermost ends of all of the beams 59, 62, 63, 64, 65, 70, 71, 72 and 73 hold a jacket 74 which surrounds the upper end of the chimney 35, the upper ends of all of said beams that have just been mentioned being provided with jacket supports 75 (FIG. 6) for this purpose. The chimney 35 comprises all of the air and flue outlets of the bungalow which, in the described, has four such outlets.

Intermediate roof portion supports 80, 81, 82 and 83 are provided approximately midway between the assembly of supporting beams 36, 37, 38 and 39 and the periphery of the roof, said supports 80, 81, 82 and 83 co-operating with the corresponding roof portions 30, 31, 32 and 33. The intermediate roof portion supports 80 to 83 also constitute partitions for the loft space that is enclosed beneath the roof 2 and above the room units or sections 3 to 7. The intermediate support 80 is located above that side of the room unit or section 6 that adjoins the room unit or section 7 (see FIG. 3), a floor 85 (see FIG. 9) being arranged on top of section 6 in engagement with the skeletal beams. In particular, one edge region of the floor 85 bears against the upper flange of a beam 84 of said skeleton that extends along the upper edge of one of the longer sides of section 6. A plurality of vertical supporting beams 86 that are arranged in horizontaly spaced apart relationship extend upwardly from the edge region of the floor 85 that is located in vertical register with the underlying flange of the beam 84. Horizontal girders 87 and 88 extend alongside the lower and upper ends of the vertical supporting beams 86 and the supporting beams 61 of the incline roof portion 30 bear downwardly upon the upper girder 88 and the upper ends of the beams 86. A vertical separation wall 89 is secured to the lower girder 87 and to the upper girder 88 and extends upwardly from the floor 85 to between the relatively spaced supporting beams 61.

The intermediate roof portion supports 82 and 83 that co-operate with the inclined roof portions 32 and 33 respectively are of symmetrically opposite but otherwise substantially identical construction and this construction is shown in detail in FIG. 10 in respect of the support 83. A horizontal beam 90 extends across the width of the three room units sections 4, 5 and 6 although it is possible, as an alternative, to replace the single beam 90 by three substantially coaxial beams each of which has a length equal to the width of one of said units sections 4, 5 or 6. Vertical supporting beams 91 are arranged on top of the horizontal beam 90 in horizontally spaced apart relationship with their upper ends holding the supporting beams 56 and 71 of the inclined roof portion 33. To this end, a horizontal girder 92 extends alongside the upper ends of the supporting beams 91 and is secured to those supporting beams and to the supporting beams 56 and 71 of the roof portion 33. A vertical partition 93 is secured to the beam 90 and to the girder 92 and extends upwardly to between the beams 56 and 71 of the roof portion 33. The partition 93 may be made from a material such as hardboard or wood. A further horizontal girder 94 extends alongside the beam 90 on top of the floor 85 and is secured to both those parts so as to reinforce the connection of the beam 90 to the floor 85.

Parts of the supporting beams 73 and 95 (FIGS. 5 and 11) are sustained by the intermediate roof portion support 81. This support 81 includes a generally vertical girder framework 96 (FIGS. 3, 4 and 11), said framework being comprised by a horizontal top member 97 one end of which merges into an inclined top member 78. The framework 96 also includes a horizontal lower beam 98 one end of which meets the lower end of the inclined top member 78. A plurality, such as six, of horizontally spaced apart upright posts 99 interconnect the top member 97 and the lower member or beam 98, there being a plurality of inclined struts 100 (FIG. 4) that extend between the upper and lower members 97 and 98 in the spaces between the posts 99. As can be seen in FIG. 3 of the drawings, the girder framework 96 is of greater horizontal length than the intermediate roof portion support 80. The girder framework 96 has a horizontal length 102 (FIG. 3) which is such that one of its ends is located above the aforementioned principal end or head wall 103 (FIG. 4) of the unit section 4 its opposite end is located nearly, but not exactly, above an intermediate partition wall 104 of the unit section 4 that separates the living room 11 from the study or other room 12. The girder framework 96 has a portion 101 that is of rectangular shape when seen in elevation and also a portion 109 that is of triangular shape when seen in elevation. That side of the girder framework 96 which faces the center of the loft space of the bungalow is covered by a partition 105 that is secured to a lower horizontal girder 106 and to an upper horizontal girder 107, said girders 106 and 107 being arranged on the floor 85 and the lower surfaces of the supporting beams 73 and 95 respectively. As can be seen in FIG. 11 of the drawings, the girder framework 96 is located above, and in substantially vertical register with, the upper flange of an upper horizontal beam 108 of the skeleton of the room unit section A flat supporting beam 110 (FIG. 12) surrounds the top of the living area that is defined by the room units or sections 3 to 7 and is located above the upper longitudinal skeletal beams of the sections 3 and 7 and the upper lateral skeletal beams of the sections 4, 5 and 6. One upper longitudinal skeletal beam 111 of the room unit section 3 can be seen in FIG. 12 of the drawings. The beams 110 have secured to them the lower and outer ends 112 of all of the various supporting beams of the four inclined roof portions 30 to 33 and it will be noted from FIG. 4 and 12 of the drawings that outer edge regions of the four roof portions are bent over upwardly through a few degrees relative to the remainder thereof so that said outer edge regions are less inclined to the horizontal than are the major and upper parts of the roof. FIG. 12 shows the lower edge region 113 of the inclined roof portion 31 and this lower edge region bears upon underlying supporting beams 114 which are secured to the upper surfaces of the lower and outer ends 112 of the various supporting beams such as the beam 95 that can be seen in FIG. 12. The supporting beams 114 are also held in position by angle irons 115 that are fastened to the tops of the flat beams 110 and to the sides of the supporting beams 114 themselves.

The supporting beams of the four roof portions 30 to 33 and the supporting beams 114 of the lower edge regions of the roof 2 are covered by, for example, waterproof roofing material 116 on top of which a plurality of tile purlins 117 are arranged in parallel and spaced apart relationship. Roofing tiles 118 are mounted on the purlins 117 and gutters 119 are disposed around the lower and outer edge of substantially the whole of the roof 2, said gutters 119 forming parts of ornamental eaves 120. Cover boards 122 extend between the lower edges of the eaves 120 and the walls of the living area of the bungalow, such as the wall 121 shown in FIG. 12, and rain water pipes 123 are connected to the gutters 119 above the cover boards 122 so as to extend downwardly therefrom above said cover boards to alongside the walls (such as 121) near to which they pass through openings in the boards 122. Roller or venetian blinds 124 may be arranged above the cover boards 122 for co-operation with various windows in the outer walls of the bungalow.

The aforementioned floor 85 of the loft space of the bungalow is of such a construction that it can be walked on but the peripheral area of the loft space, around the floor 85, has a horizontal covering 130 (FIG. 12) that is not designed for walking on. However, it preferably has sufficient strength to serve as a storage area for infrequently used light-weight items such as pieces of luggage and the like. The room units or sections 3, 4, 5, 6 and 7 are prefabricated in a factory and, during this prefabrication process, the skeletons are made and have the floors 133 (FIG. 4), the ceilings 131 and the principal walls 103 and 132 fastened to them. When finished, the various room units or sections are self-supporting and thus constitute supporting portions of the bungalow or other building of which they will form parts.

Although in the described embodiment each room unit or section has the shape of a parallelepiped, this is not essential and some or all of the room units or sections may be differently shaped. The room units or sections are transported from the prefabrication factory to the building site are juxtaposed on a foundation, having main service connections, and are then fastened to one another to form the single story 1, whose sectional plan can be seen in FIG. 2 of the drawings. It is emphasized that a single story bungalow has been described merely as an example and that buildings having two or more storys may be constructed in accordance with the invention, it not being essential that any lower story or storys should be of a prefabricated construction. A building in accordance with the invention need not necessarily be a dwelling and could be an office or other business premises. The various room units or sections may be secured to the foundation in such a way as to be readily disconnectible therefrom to enable the whole building to be moved to another site.

When the story 1 has been assembled on the building site, the roof 2 is arranged on top of the room units or sections 3 to 7. In order to facilitate and speed up the installation of the roof 2, the two arched roof supports afforded by the parts 40, 43 and 36 and 41, 42 and 37 respectively are disposed on the central room unit section 5 of the story 1 during the prefabrication thereof. During transport to the building site, the arched roof supports that have just been mentioned conveniently occupy the downwardly tilted positions that are shown in broken lines in respect of one of them in FIGS. 6 and 7 of the drawings. In these positions, the beams or bars 44 are connected to the supports 47 by only the bolts 45 which bolts are in substantially axial alignment with one another thus forming a pivotal axis. When the building site is reached, it is only necessary slightly to loosen the bolts 45, to turn the arched roof supports upwardly about the axes that have just been mentioned, to retighten the bolts 45 and to insert and tighten the bolts 46. The arched roof supports will then be reliably fixed in their upright positions. It will, of course, be realized that the arched roof support afforded by the parts 41, 42 and 37 will lie to the right of the corresponding supports 47, as seen in FIG. 6 of the drawings, when it is in its lowered or inoperative position in contradistinction to the arched roof support afforded by the parts 40, 43 and 36 which is shown in broken lines in the same Figure lying to the left of the corresponding supports 47. When the two arched roof supports have been erected, the connecting beams 38 and 39 are secured thereto with the aid of the lugs or plates 50 (FIGS. 7 and 8) and the bolts 51 and 52. Once the beams 36 to 39 are rigidly mounted in their appointed positions, the various supporting beams of the four inclined roof portions 30 to 33 can be arranged thereon and secured thereto.

The supporting beams of the inclined roof portions 30 to 33 are secured at their lowermost and outermost ends to the flat supporting beams 110 as shown in FIG. 12 of the drawings, said beams 110 and the angle irons 115 preferably being wholly or partly mounted on the tops of the room units or sections 3 to 7 during the prefabrication thereof at the factory. Under these circumstances, the beams 110 at the shorter sides or ends of the units or sections 3 to 7 cannot have lengths greater than the widths 9 (FIG. 2) of each of those units or sections. If it is considered desirable to employ longer beams 110, then those beams must be placed in position after the interconnection of the five room units or sections at the building site. The projecting angle irons 115 (FIG. 12) may also be connected to the beams 110 at the building site if their projecting portions would otherwise cause transport difficulties between the factory and the building site. After the supporting beams of the roof have been placed in position, the intermediate roof portion supports 80 to 83 can be installed but, as an alternative, the intermediate roof portion supports 80 to 83 can be installed before mounting the supporting beams of the inclined roof portions. In particular, the girder framework 96 may advantageously be installed on top of the room unit or section 4 before the supporting beams of the inclined roof portion 31 are placed in their appointed positions. Once the supporting beams of the roof 2 are all in position, the roofing material 116 is mounted thereon followed by the purlins 117 and the roofing tiles 118. The gutters 119, ornamental eaves 120, cover boards 122 and rain water pipes 123 are all installed at convenient stages during the finishing of the roof 2 after its inclined portions 30 to 33 are basically formed.

The mounting of the supporting beams 40 to 43 on top of only the single room unit section 5 has the advantage that the roof 2 can be supported in a simple manner, the beams 40 to 43 being easily arranged on the room unit section 5 in the manner that has been described above during the production of that section at the factory. The connection of the supporting beams 40 to 43 to only one of the sections of the bungalow ensures their correct position and avoids any necessity for having to fit them to two or more juxtaposed room units or sections at a building site. The girder framework 96 extends throughout the length 135 (FIG. 2) of the living room 11 and its opposite ends are positioned the principal end or head wall 103 and above the internal partition wall 104 respectively. This arrangement has the advantage that heavy beams and other parts of the roof 2 that bear against the girder framework 96 are not directly sustained from beneath by the top of the room unit section 4 throughout the length 135 of the living room 11 which room does not, of course, have any internal load-bearing walls or other partitions. Because of the provision of the girder framework 96, the horizontal beam 108 (FIG. 11) of the skeleton of the room unit or section 4 need not be of any heavier construction than the other skeletal beams of the same section and those of the other sections 3, 5, 6 and 7. This simplifies the production of the room units or sections since all of them may have the same basic skeletal structure. The intermediate roof portion supports 80 to 83 conveniently carry the walls and partitions 89, 93 and 105 which together form the central portion of the space beneath the room 2 into a useful enclosed loft whose floor 85 can be walked on without taking any precautions. The loft space extends above the three room units, or sections 4, 5 and 6 and is preferably accessible from the central room unit or section 5 by way of a permanently positioned or retractable staircase or ladder that is not shown in the drawings and that does not need to be particularly described. It will be remembered that the space around the central loft has a horizontal covering 130 affording a floor that is suitable for light storage purposes and at least one closable opening (not shown) may be formed through the partition or wall of each of the intermediate roof portion supports 80 to 83 for convenient access to that storage space.

Due to the fact that the supporting beams of the roof 2 are sustained from beneath near the roof ridge, which ridge is located near the top of the chimney 35 in the bungalow which has been described by way of example, the upper ends of the supporting beams of the roof are satisfactorily held in their appointed positions. It will be seen from FIG. 5 of the drawings that a generally oblong space is formed between the upper ends of the various supporting beams of the roof 2 which space is substantially filled by the upper end of the chimney 35. The chimney jacket 74 (FIG. 6) is firmly mounted on the jacket support 75 at the upper ends of the supporting beams of the roof 2 because those supporting beams are themselves sustained from beneath by the horizontal beams 36, 37, 38 and 39 at distances of only substantially 60 centimeters from the extreme upper ends of the supporting beams. The unsustained spans of the various supporting beams of the inclined roof portions 30 to 33 have advantageous lengths owing to the provision of the intermediate roof portion supports 80 to 83 and the location of the beams 36 to 39 at only short distances from the upper ends of the longer supporting beams. Because of the relatively short unsustained spans of the supporting beams of the roof, those beams can be of relatively small cross-sectional area thus saving in material, weight and expense and facilitating the easy installation of the roof 2. Neighboring parallel supporting beams of the various inclined roof portions 30 to 33 are preferably spaced apart from one another by a perpendicular distance 136 (FIG. 5) of substantially 60 to 65 centimeters. The provision of the girder framework 96 above the living room 11 that is partially defined by the room unit section 4 enables the inclined roof portion 31, in particular, to be satisfactorily supported without requiring an increase in the strength or weight of the skeleton or other parts of 4. It is emphasised that the bungalow illustrated in the accompanying drawings has been described merely as one practical example of the application of the invention to a building. A roof having only two inclined portions forming a roof ridge that extends parallel to the shorter sides or ends of the room units sections 3 to 5 could also be supported in a similar manner to that which has been described. In such a case, the roof ridge could be disposed substantially centrally above the juxtaposed sections or could be disposed towards one side thereof as might be desired. In the latter case, one roof portion will, of course, be larger than the other. The roof supports could, with such a construction, be pivotally mounted on, for example, the top of one room unit or section. Only relatively parallel intermediate roof portion supports would be required with such a construction instead of the four supports 80 to 83 that have been described above which supports are arranged in a rectangle.

With a roof having relatively long and relatively short inclined surfaces, it may be sufficient to employ only a single roof support for the longer surface. When such a roof support is arranged substantially centrally on top of a room unit or section, its length will preferably not be greater than half the total length of that room unit or support so that it can be laid down on top of the room unit or section by means of a pivotal connection thereto in generally the manner which is shown in broken lines in FIG. 6 of the drawing for the arched roof support afforded by the parts 40, 43 and 36. When a roof support is arranged at some distance from the center of the top of a room unit or section, it may, if absolutely necessary, be longer (taller) than half the length of that room unit or section. Although the roof supports that have been particularly described above are of arched configuration, that is not essential and they may be of different shapes. The room units or sections may have different dimensions to those of the room units or sections 3 to 7 that have been particularly described and the roof 2 may have an outer covering that is not afforded by the tiles 118.

Although certain features of the building and its method of construction that have been described and/or illustrated in the accompanying drawings will be set forth in the following claims as inventive features, it is emphasized that the invention is not necessarily limited to those features and that is includes within its scope all of the parts of the building and the steps in its method of construction that have been described and/or illustrated both individually and in various combinations.

What we claim is:

1. A building comprised of a plurality of prefabricated space-bounding sections and a roof spaced over the top of the sections, at least two pairs of roof support members for said roof connected to the top of at least one said section which is elongated and is provided with two longer sides, said pairs of support members being spaced apart, said roof support members in each said pair each being coupled with an opposite one of said longer sides and selectively movable from a substantially horizontal position on the top of said one section to the substantially upright position they occupy supporting said roof in the completed building whereby said one section is adapted to be transported to the building site with said roof support members in said substantially horizontal position, each said roof support member including a supporting beam and connection means at one end of said supporting beam, said connection means including pivot means connected to a first location on top of said one section for pivoting said roof support member from said substantially horizontal position for transport purposes to said substantially upright position it occupies in the completed building, the axis of said pivot means being horizontal and perpendicular to the longer side of said elongated section, said connection means further including securing means connected at least in part to a second location spaced from said first location adapted for rigidly securing said roof support member in said latter position, the other ends of each said supporting beam in each said pair being rigidly connected together with a horizontal transverse beam, each said pair of supporting beams being pivoted in opposite directions from the other of said pair and from said horizontal position to said upright position towards each other.

2. A building as claimed in claim 1 wherein each said pivot means is horizontally spaced from said securing means when said roof support members are in a substantially upright position, said securing means comprising a bolt rigidly fastening said connection means to the top of said one section.

3. A building as claimed in claim 1, wherein each of said roof support members, when in an upright position, have a height which is not greater than one-half of the maximum length of said one section and which is substantially less than the distance from the highest part of said roof above the top of said elongated section.

4. A building as claimed in claim 1, wherein said roof support members include a beam having a foot which extends transversely relative thereto comprising said connection means connected by two bolts which are horizontally spaced apart when said support members are in an upright position and which comprise said means for pivoting and securing each said roof support members to an anchorage at the top of said one section, at least one of said two bolts being removable whereby said roof support members can be pivoted to said substantially horizontal position.

5. A building as claimed in claim 4 wherein said anchorage comprises a support fixedly mounted on the top of said one section, and wherein said foot is located alongside the support and is adapted to be clamped thereto by said bolts.

6. A building as claimed in claim 1, wherein upper supporting beams are arranged around the periphery of the building on the top of said sections, said roof including outer regions which are secured to said upper supporting beams.

7. A building as claimed in claim 6, wherein said roof comprises at least one inclined lower roof portion which includes said outer regions and which is inclined to the horizontal at a smaller angle than a major upper region of said roof.

8. A building as claimed in claim 7, wherein said roof is provided with eaves which are horizontally spaced from neighboring substantially vertical outer surfaces of the building.

9. A building as claimed in claim 1, wherein said roof includes roof support beams and each of said roof support members is provided with at least one fastening member to which said roof support beams are secured.

10. A building as claimed in claim 1, wherein at least one intermediate roof support is provided between the edge of said roof and a said pair of said roof support members, said intermediate roof support member comprising a girder framework which is parallel substantially throughout its length to a frame beam provided on the top of the underlying section and is substantially juxtaposed above said frame beam.

11. A building as claimed in claim 10, wherein said girder framework comprises a rectangular portion and an adjoining triangular portion, the top of said triangular portion extending substantially parallel and in juxtaposition to the lower surface of the neighboring portion of said roof, said girder framework being arranged to span a room defined by the underlying section, the spanned length of said room not being greater than the length of said girder framework.

12. A building as claimed in claim 10, wherein as seen in plan, there are a plurality of said intermediate roof support members which together substantially enclose a central generally rectangular space beneath said roof.

13. A building as claimed in claim 12, wherein each said intermediate roof support member is provided with at least one wall member secured to beams of said each intermediate support member.

14. A building as claimed in claim 13, wherein said rectangular space is provided with a floor capable of sustaining the weight of persons walking thereon.

15. A building as claimed in claim 13, wherein each said wall comprises a plurality of boards.

16. A building as claimed in claim 10, wherein said intermediate roof support member is arranged in substantially vertical register with a long side of a section of the plurality of sections.

17. A building comprising a plurality of prefabricated space bounding elongated box-shaped sections and a roof spaced over the top of said sections, two pairs of roof support members for said roof connected to the top of at least one said section, said roof over said one section having a ridge proximate the center of said section, the roof being inclined downwardly from said ridge towards the shorter sides of said one section, said pairs of support members being located at both sides of the central portion of said one section proximate the longer sides thereof whereby one pair of support members are on one side of the center of said one section and the other pair are on the other side as seen in plan, each said pair of roof support members being selectively movable in an arcuate movement towards each other from a substantially horizontal position on the top of said one section to the substantially upright position they occupy supporting said roof in the completed building whereby said one section is adapted to be transported to the building site with said roof support members in said substantially horizontal position, each said roof support member including means for connecting same to the top of said one section, said connection means including means for pivoting said roof support member about a horizontal axis transverse to the length of said one section from said substantially horizontal position for transportation to said substantially upright position which it occupies in the completed building, said connection means further including means for rigidly securing said roof support member in said latter position, each pair of said support members including a horizontal beam which rigidly connects the outward ends thereof.

18. A building comprised of at least five side-by-side prefabricated space-bounding elongated boxshaped sections and a roof spaced over the top of said sections, two pairs of spaced apart roof support members for said roof connected to the top of a centrally disposed section of said sections, each pair of roof supports having the configuration of an inverted "U", said pairs of roof support members each being selectively pivotable from a substantially horizontal position wherein each pair extend in an opposite direction from its respective pivot relative to the other pair on the top of said central section to the substantially upright positions they occupy supporting said roof in the completed building whereby said central section is adapted to be transported to the building site with said roof support members in said substantially horizontal position, two of said sections at one side of said central section defining a room which occupies the major portion of both said two sections, the top of said room where said two sections are joined being without means of underlying vertically disposed support for the major length of said sections, a girder framework being provided above said two sections proximate and parallel to where said two sections are joined, said framework spanning said room and being supported at walls of said two sections provided at either end of said room, said framework also supporting at least in part said roof above said two sections.

19. A building comprised of a plurality of prefabricated space-bounding sections having metal frameworks and a roof spaced over the top of said sections, roof support members for said roof connected to the top of at least one of said sections, each support member having two vertical beams which are pivotably connected to said framework on their inner ends and are rigidly connected together by a further horizontal beam on their outer ends whereby they have the configuration of an inverted "U", said roof support members being selectively movable from a substantially horizontal position on the top of said one section to the substantially upright position they occupy supporting said roof in the completed building whereby said one section is adapted to be transported to the building site with said roof supports in said substantially horizontal position, each said roof support including connection means at the inner end of each said vertical beam, each said connection means including pivot means at the lower portion of said support member about which it is adapted to be pivoted from said substantially horizontal position for transport purposes to the said substantially upright position it occupies in the completed building, each said connection means further including securing means which is at least in part horizontally spaced from said pivot means and adapted to pivot with the lower portion of said support member and provide the rigid securing of said roof support member to said framework of said one section in its said upright position.

20. A building comprised of a plurality of elongated prefabricated space-bounding sections and a roof spaced over the top of said sections, roof support members for said roof connected to the top of at least one of said sections, each said roof support members having the configuration of an inverted "U", said roof support members being selectively movable from a substantially horizontal position on top of said roof in the completed building whereby said one section is adapted to be transported to the building site with said roof support members in said substantially horizontal position, weight bearing structural beams included in said one section at its top, our spaced apart projections rigidly connected to and extending upwardly from said beams and the top of said one section, each said roof support member including a pair of connection means each of which are connected to at least a corresponding pair of said projections, each said connection means including pivot means for pivoting said roof support member relative to its corresponding said projection to which it is connected from said substantially horizontal position for transport purposes to the said upright position it occupies in the completed building, each said connection means including further means spaced at least in part from said pivot means therein for rigidly securing said roof support member to a corresponding pair of said projections in said latter position, said support members having their pivot axes transverse to the length of said one section and being spaced apart in the longer direction of said one section.

21. A building comprised of a plurality of prefabricated space-bounding elongated box-shaped sections and a roof spaced over the top of said sections, roof support members for said roof connected to the top of at least one of said sections which is provided with longer and shorter sides, said roof support members being spaced apart in the longer direction of said one section, said roof having an upper ridge falling substantially in a vertical plane which extends through the center of said one section and is perpendicular to said longer sides, said roof support members being spaced laterally away from said ridge whereby said ridge in the completed building is spaced above the central portion of the top of said one section without the intervention of vertically disposed support members, said support members being selectively movable from a substantially horizontal position on the top of said one section to the substantially upright position they occupy supporting said roof in the completed building whereby said one section is adapted to be transported to the building site with said roof support members in said substantially horizontal position, each said roof support member including connection means connecting it to the top of said one section, said connection means including pivot means for pivoting said roof support member about a horizontal axis transverse to said one section's length from said substantially horizontal position for transport purposes to the substantially upright position it occupies in the completed building, said connection means further including securing means spaced at least in part from said latter position, said connection means being spaced between the center of said one section and a shorter side thereof.

22. A building comprised of a plurality of prefabricated space-bounding sections and a roof spaced over the top of the sections, a pair of roof support members for said roof connected to the top of at least one said section which is elongated, said support members being spaced apart in the direction of length of said one section, said roof support members being selectively movable from a substantially horizontal position on the top of said one section to the substantially upright position they occupy supporting said roof in the completed building whereby said one section is adapted to be transported to the building site with said roof support members in said substantially horizontal position, each said roof support member including connection means, said connection means including means for pivoting said roof support member from said substantially horizontal position for transport purposes to said substantially upright position it occupies in the completed building, said pivot means having axes which are perpendicular to the length of said one section, said connection member in said latter position, said securing means including two spaced apart fastening means rigidly connecting said support member to the top of said section in its said upright position, said fastening means being one on each side of the longitudinal axis of said support member.

23. A building comprised of a plurality of prefabricated space-bounding sections situated to form a rectangular as seen in plan and a roof spaced over the top of said sections, a pair of spaced apart roof support members for said roof connected to the top of at least one of said sections, each said pair of roof support members having the configurations of an inverted "U", said roof support members each being selectively movable from a substantially horizontal position on the top of said one section to the substantially upright position they occupy supporting said roof in the completed building whereby said one section is adapted to be transported to the building site with said roof support members in said substantially horizontal position, each said roof support member including connection means, said connection means including means for pivoting said roof support member from said substantially horizontal position for transport purposes to the said substantially upright position it occupies in the completed building, said connection means further including means for securing said roof support member in said latter position, said connection means of said pair of roof support members coinciding with the corners of a horizontal rectangle which surrounds the center of the top of said one section, the upper ends of said pair of roof support members being rigidly connected together by four horizontal beams including two beams comprising the upper side of the inverted "U" configuration, which are connected together to form a horizontally disposed rigid rectangular structure.

24. A building comprised of a plurality of prefabricated space-bounding elongated box-shaped sections situated to form a rectangle as seen in plan and a four sided roof spaced over the top of said section, a pair of spaced apart roof support members for said roof connected to the top of at least one of said sections, said roof support members being selectively movable from a substantially horizontal position on the top of said one section to the substantially upright position they occupy supporting said roof in the completed building whereby said one section is adapted to be transported to the building site with said roof support members in said substantially horizontal position, said one section having a framework of metal beams which extend along said one section's horizontal and vertical edges, each said roof support member including connection means, each said connection means including means for moving each said roof support member from its said substantially horizontal position for transport purposes to the said substantially upright position it occupies in the completed building, said connection means further including means for securing said roof support member in said latter position, said connection means of said pair of roof support members each being rigidly secured to said beams disposed along the upper longer sides of said framework and coinciding with the corners of a horizontal rectangle surrounding the center of the top of said one section, the upper ends of said support members connected when they are in an upright position by beams provided to form with said support members a rectangular frame, each side of said roof supported at least in part by one of such beams.

25. A building which is rectangular as seen in plan comprised of a plurality of prefabricated space bounding box-shaped sections and a four sided roof spaced over the top of said sections, a pair roof support members for said roof connected to the top of at least one said section, each said roof support including a pair of connected pivotable beams, said roof support members each being selectively movable from a substantially horizontal position on the top of said one section to the substantially upright position they occupy supporting said roof in the completed building whereby said one section is adapted to be transported to the building site with said roof support members in said substantially horizontal position, each said pivotable beams of said roof support member including connection means, each said connection means including means for pivoting its corresponding said roof support member in said latter position, and in the completed building a chimney extending substantially upwardly from the center part of said one section between said pivotable beams of said roof support members, the upper ends of said roof support members being rigidly connected to said roof, horizontal beams connecting the upper ends of said roof support members, said horizontal beams surrounding without touching said chimney and each such beam directly supporting at least in part one side of said roof.

26. A building as claimed in claim 25, wherein said one section is an elongated box-shaped section and further elongated box-shaped sections of said sections are connected to the longer sides of said one section on each side thereof, only said one section having said roof support members connected to the top thereof.

* * * * *